United States Patent [19]

Lidstrand

[11] Patent Number: 4,458,764

[45] Date of Patent: Jul. 10, 1984

[54] DEVICE IN ROCK OR EARTH DRILLING APPARATUS FOR ROTARY DRILLING

[75] Inventor: Eskil Lidstrand, YSkärholmen, Sweden

[73] Assignee: Craelius AB, Marsta, Sweden

[21] Appl. No.: 381,439

[22] Filed: May 24, 1982

[30] Foreign Application Priority Data

Jun. 1, 1981 [SE] Sweden ..... 8103433

[51] Int. Cl.[3] ..... E21C 1/10

[52] U.S. Cl. ..... 173/153; 60/424; 91/61; 91/520; 173/157; 173/164; 173/147; 175/85

[58] Field of Search ..... 173/149, 150, 147, 32, 173/164, 154, 152, 153, 157; 175/85; 81/57.16, 57.34; 91/61, 520; 92/2; 60/424

[56] References Cited

U.S. PATENT DOCUMENTS

| | | | |
|---|---|---|---|
| 2,930,587 | 3/1960 | Seawright | 173/153 |
| 3,613,804 | 10/1971 | Jonsson | 173/149 |
| 3,662,842 | 5/1972 | Bromell | 173/164 |
| 3,680,412 | 8/1972 | Mayer et al. | 81/57.16 |
| 3,696,872 | 10/1972 | Jonsson | 173/149 |
| 3,942,592 | 3/1976 | Hodge | 173/157 |
| 4,037,672 | 7/1977 | Hodge | 173/157 |
| 4,128,135 | 12/1978 | Mitchhart et al. | 173/164 |

FOREIGN PATENT DOCUMENTS 390833 1/1977 Sweden .

*Primary Examiner*—Frank T. Yost
*Assistant Examiner*—Hien H. Phan
*Attorney, Agent, or Firm*—Barnes & Thornburg

[57] ABSTRACT

A device in rock or earth drilling apparatus for rotary drilling including an axially stationary chuck (21) and an axially movable chuck (27) which is rotated by a reversible pressure fluid driven rotary motor (32) having a pressure fluid supply conduit for each direction and which is moved forwards and backwards by a reversible pressure fluid driven feed motor (17) having a pressure fluid supply conduit (18, 19) for each direction, the chucks being actuated to withdraw from or insert in a drill hole a drill string (23) composed by a number of threaded string elements and (are also actuated) to make or break the joints between the string elements. One of the pressure fluid supply conduits (18 or 19) of the feed motor is connected to one of the pressure fluid supply conduits (37 or 36) of the rotary motor (32) via a conduit (100), so that when breaking or making the joint between two string elements gripped by the two chucks (21, 27) the feed motor will be actuated to move the axially movable chuck (27) relatively to the stationary chuck (21) in a direction to decrease the pressure on the threads accomplished by the weights of the axially movable chuck and devices (such as 32) connected thereto.

A suitable illustration is FIG. 3.

9 Claims, 3 Drawing Figures

DEVICE IN ROCK OR EARTH DRILLING APPARATUS FOR ROTARY DRILLING

DESCRIPTION

1. Technical Field

The present invention relates to a device in rock or earth drilling apparatus for rotary drilling including an axially stationary chuck and an axially movable chuck which is rotated by a reversible pressure fluid driven rotary motor having a pressure fluid supply conduit for each direction and which is moved forwards and backwards by a reversible pressure fluid driven feed motor having a pressure fluid supply conduit for each direction. The chucks are actuated to withdraw from or insert in a drill hole a drill string composed by a number of threaded string elements and are also actuated to make or break the joints between the string elements.

2. Background Art

A device as described above is previously known through U.S. Pat. No. 3,613,804, for instance.

When the threaded joint between two string elements shall be made or broken by means of said device, the axially stationary chuck grips one of the elements while the axially movable chuck grips the other element and rotates it. When the drilling apparatus is used for drilling downwards, the axially movable chuck and devices connected thereto, such as rotary motor and gear box, with their total weight will press the rotating string element towards the stationary string element during the breaking operation which has the effect that the threads of the string elements with great force will be pressed against each other. When the apparatus is used for drilling upwards the total weight of the axially movable chuck, the rotary motor, etc. (which can be several hundred kilograms) will result in moving the rotating string element in a direction from the stationary string element when making the joint which has the effect that also in this case the threads are pressed against each other with a great force.

Especially when the threads are conical and/or very fine they will be worn very fast during the relative motion between the string elements so that their life will be shortened.

DISCLOSURE OF INVENTION

It is an object of the present invention to remove the above disadvantages and to provide a device which, in a very simple manner, relieve the threads of the string elements when making and breaking their joints.

This object is fulfilled by giving the device according to the invention the characteristics stated in the claims.

BEST MODE FOR CARRYING OUT THE INVENTION

Figure 1:
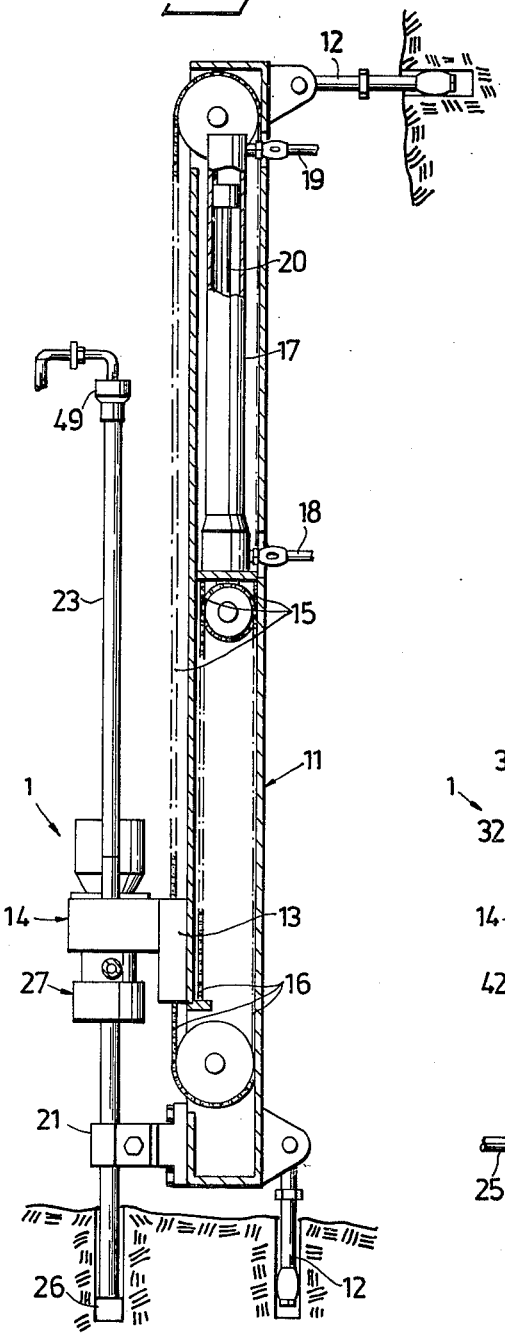
FIG. 1 is a side view, partly in section, of a rock or earth drilling apparatus including the device according to the present invention.
Figure 2:
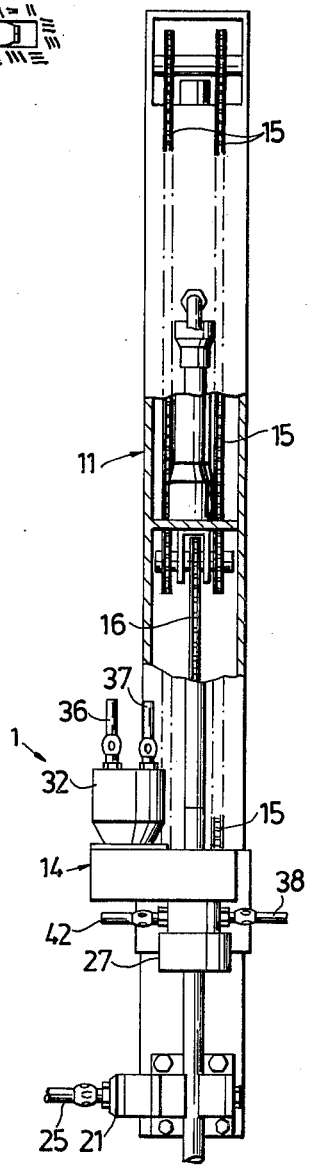
FIG. 2 is a front elevation, partly in section, of the drilling apparatus illustrated in FIG. 1.

The drilling apparatus illustrated in the FIGS. 1 and 2 has a feed bar 11 which is supported by expanding units 12. Alternatively the feed bar may be carried by a wheeled substructure or be supported in another suitable way. A slide 13, carries a drill 14, and is slidable along the feed bar 11 by means of two parallel chains 15, a chain 16, and a feed motor 17 in the form of a cylinder with a reciprocating piston rod 20. The feed motor 17 has two supply conduits 18, 19. If pressure fluid is supplied through the supply conduit 18, the piston rod 20 retracts and the chain 16 pulls the slide 13 forwards, i.e. downwards in FIG. 1. If, alternatively, pressure fluid is supplied through the supply conduit 19, the slide 13 is pulled backwards, i.e. upwards in FIG. 1, by means of the chains 15.

A stationary chuck 21 is disposed at the forward portion of the feed bar 11. Its jaws (not shown) are biased into engagement with a drill string in the form of a drill pipe 23. By the action of pressure fluid through a conduit 25 the jaws are forced to release the drill pipe 23.

The drill pipe 23 comprises several pipe elements and a drill bit 26 which are joined by screw joints. For rock drilling, the drill bit 26 may be a pipelike diamond drill bit and the first pipe element may be a so-called core pipe for collecting a core. A swivel 49 supplies flush water to the drill pipe.

A chuck 27 is a part of the drill 14, and is rotatably journaled therein. Thus, the chuck 27 moves with the drill 14.

A reversible, pressure fluid actuated rotary motor 32 is arranged to rotate the chuck 27 over a gearing. The rotary motor 32 has two alternative supply conduits 36, 37. When pressure fluid is supplied through the conduit 36, the motor 32 rotates forward, and when pressure fluid is supplied through the conduit 37, the motor reverses.

Figure 3:
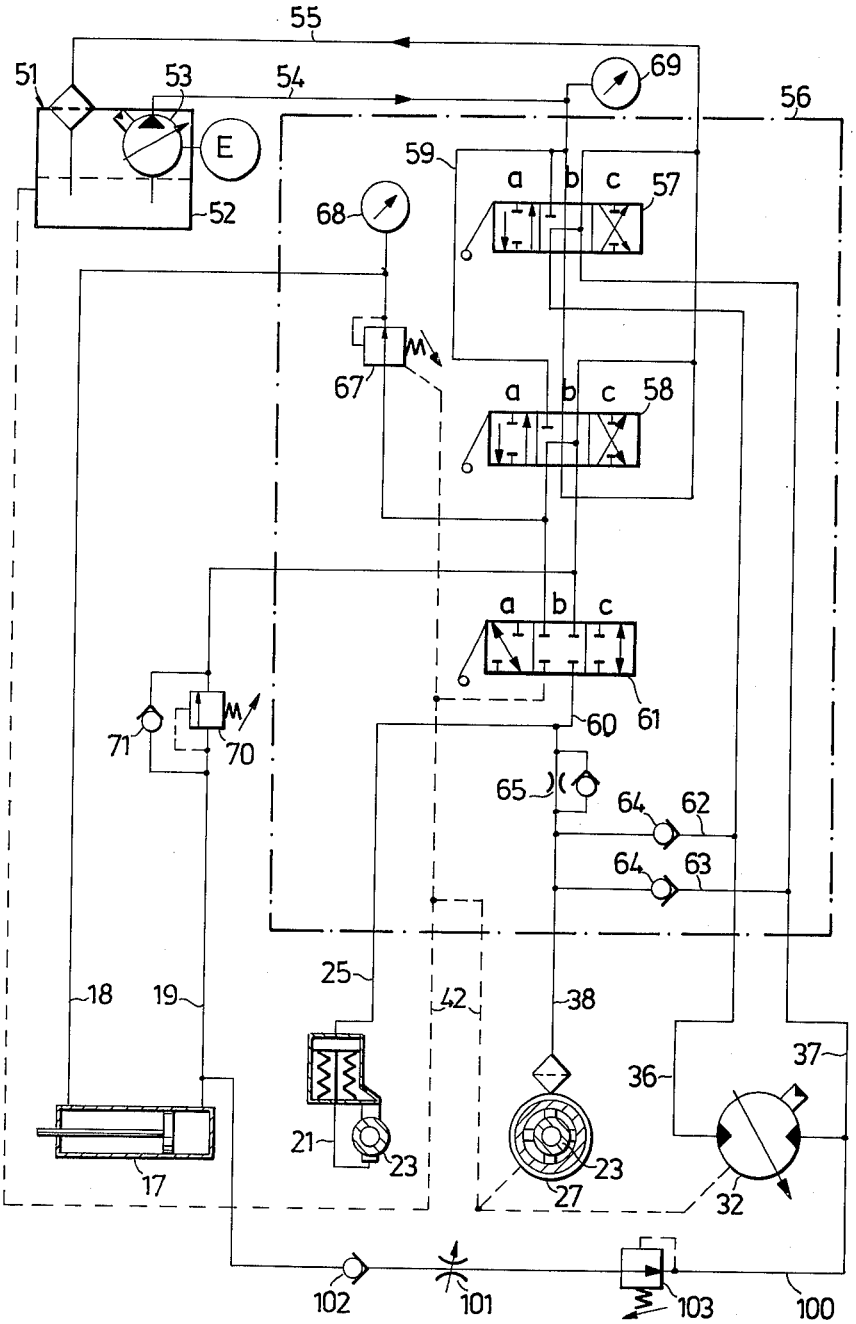
FIG. 3 is a diagram of the pressure fluid system of the drilling apparatus illustrated in FIGS. 1 and 2.

Pressure fluid is supplied to the chuck 27 through a conduit 38 and is conveyed back to a sump 52 by means of a drain conduit 42 (FIG. 3). When pressure fluid is supplied through the conduit 38, jaws (not shown) of the chuck 27 grip the drilling pipe 23. The jaws are hold in disengaged position when there is no pressure in the conduit 38.

In the conduit diagram, FIG. 3, the chucks 21 and 27, the feed motor 17, the rotary motor 32, and the conduits 18, 19, 25, 36, 37, 38, 42 all of which are described above, are represented. The reference numeral 51 refers to a pressure fluid supplying unit, which comprises the sump 52 and a pump 53 which is driven by a motor E. Normally, the pressure fluid supplying unit 51 is situated some distance away from the drilling apparatus. The pump 53 supplies pressure fluid, preferably pressure oil, through a main conduit 54 to a control unit 56, which is indicated by means of dash-and-dot lines. Preferably the pump 53 is pressure compensated, so that is supplies oil of a constant pressure independently of the amount of oil utilized. By means of a return conduit 55, oil is returned from the control unit 56 to the sump 52.

A manually operated control valve 57 for the rotary motor 32 is supplied with pressure fluid from the main conduit 54. This valve 57, which is called the rotation control valve, has three alternative positions which (FIG. 3) are referred to as positions a, b and c. With the rotation control valve in position b, as illustrated in the FIG., the conduits 36, 37 are connected to the return conduit 55, and thus the rotary motor 32 does not rotate. With the rotation control valve 57 in position a, the conduit 36 is supplied with pressure oil from the main conduit 54, and the conduit 37 is drained through the return conduit 55. Therefore, the rotary motor 32 rotates forward. With the valve in the position c, the conduit 36 is drained and the conduit 37 is supplied with pressure oil so that the rotary motor 32 rotates in reverse direction.

The axial movement of the drill 14 is controlled by means of a manually operated control valve 58, which is referred to as the feed control valve. This feed control valve 58 has also three positions which are referred to as a, b, c. With the feed control valve 58 in position b, as illustrated in the FIG., the two supply conduits 18, 19 of the feed motor 17 are connected to the return conduit 55, and the drill 14 does not move axially. If, simultaneously, the rotation control valve 57 is in position b, the main conduit 54 is directly connected to the return conduit 55 and the entire drilling appartus is idling. The feed control valve 58 is supplied with pressure oil through a conduit 59 independently of the position of the rotation control valve 57. With the feed control valve 58 in position a, pressure oil is supplied to the conduit 18, and the conduit 19 is connected to the return conduit 55. Thus, the drill 14 advances. With the feed control valve 58 in position b, pressure oil is supplied to the conduit 19, and the conduit 18 is drained. Therefore, the drill 14 now retracts.

The supply conduits 25, 38 of the two chucks 21, 27 are branches of a common supply conduit 60. With a manually operated selector valve 61 in a position a, the supply conduit 18 of the feed motor 17 is connected to the conduit 60. With the selector valve in a position c, alternatively, the other supply conduit 19 is connected to the conduit 60. With the selector valve in a position b, the conduit 60 is not connected to either of the conduits 18, 19. The conduit 38 of the movable chuck 27 is connected to both of the supply conduits 36, 37 of the rotary motor by means of two connection conduits 62, 63. The connection conduits are provided with one-way valves 64 which permit flow only in the direction of the conduit 38. Between the junctions of the connection conduits 62, 63 with the conduit 38 and the junction of the conduits 25 with the conduit 38, a one-way restrictor 65 is arranged in the conduit 38.

An adjustable pressure reducing valve 67 in the conduit 18 sets an upper limit on the feed power. A manometer 68 indicates the feed pressure. Another manometer 69 indicates the pressure in the main conduit 54. In the conduit 19 of the feed motor 17, an adjustable valve 70 of the relief valve type is arranged. This valve closes automatically when the pressure in the conduit 19 is lower than a predetermined pressure. The purposes of this valve 70 are to compensate for the weight of the drill 14 and the drill pipe 23 during drilling and to prevent the drill with the drill string to move downward because of the weight only. A one-way valve 71 is connected in parallel with the valve 70, and retraction of the drill 14 is permitted. When drilling upward is to be effected, the valves 70, 71 are connected in the conduit 18 instead of the conduit 19.

For effecting idle run, both the rotation control valve 57 and the feed control valve 58 are set in the neutral positions, i.e. the positions b. The drill pipe 23 is then held by the stationary chuck 21. When drilling is to be started, at first the selector valve 61 is set into position b, then, the rotation, control valve 57 is moved into position a. Now, pressure oil flows through the connection conduit 62 to the chucks 21 and 27 so that, simultaneously, the chuck 27 grips the drill pipe, the chuck 21 releases the drill pipe, and the chuck 27 begins to rotate. Now, when the feed control valve 58 is moved to position a, the drill 14 advances. The advance stops automatically when the piston rod 20 of the feed motor 17 reaches its retracted stop position provided the feed control valve 58 is not shifted before this position is reached.

When the rotation control valve 57 is reset into the position b, the chucks 21, 27 alternate the engagement and another pipe element can be manually screwed on to the drill pipe 23. Thereafter the swivel 49 is screwed on to the end of the drill pipe 23. When the feed control valve 58 is moved into position c, the drill 14 is returned to its retracted position. The drilling starts again when the rotation control valve 57 and the feed control valve 58 are set in the positions a.

For withdrawing of the drill pipe 23, the selector valve 61 is set in position c, and the rotation control valve 57 in position b. The feed control valve 58 is now used as a common control valve for the two chucks 21, 27 and the feed motor 17. When the feed control valve 58 is moved from position b, the neutral position, to the position c, the chuck 21 releases the drill pipe, but the chuck 27 grips the drill pipe, and withdraws it. When the feed control valve 58 is moved into position a, the chucks alternate engagement automatically, and the drill 14 advances without pushing the drill pipe forward. This is repeated, if necessary, until the drill pipe is withdrawn an appropriate length. Then, the feed control valve 58 is moved to the position b, the neutral position, and the rotation control valve 57 is moved to the position c. Now, the chuck 27 rotates in reverse direction and the supply conduit 60, common to the two chucks 21, 27, is drained through the selector valve 61 and the feed control valve 58. Through the connection conduit 62, however, the movable chuck 27 is supplied with pressure oil. On account of the restrictor 65, there is oil pressure on this chuck 27, and the chuck 27 grips the drill pipe. The stationary chuck 21, maintains its grip since the flow through the restriction valve is drained through the common supply conduit 60 of the chucks 21, 27. Therefore, if there is a screw joint of the drill rod between the chucks, this joint will be broken mechanically when the control valves 57, 58 are in these positions. In order to facilitate breaking of very tight joints, the stationary chuck 21 may be rotatable a limited angle, e.g. an angle of 25° so that an impact results.

When it is desired to reinsert the drill pipe in the drill hole, the selector valve 61 is set in position a. The movable chuck 27 will now bring the drill pipe 23 forward when the drill 14 advances, and the stationary chuck 21 will hold the drill pipe during retraction of the drill. With the rotation control valve 57 maintained in the position b, the neutral position, the reinsertion is controlled by means of the feed control valve 58. When the drill pipe 23 has been introduced so far that the stationary chuck 21 holds the outer end of the pipe, another pipe element is manually screwed on loosely, and the drill 14 is retracted. Then the rotation control valve 57 is moved to the position a. As a result, the movable chuck 27 engages and rotates the pipe element, while the stationary chuck 21 holds the drill pipe 23 because of the restriction valve 65 which is the case also during breaking of joints. Thus, the joint is made. Then, the drill pipe 23 is again inserted so far that the chuck 21 will again hold the outer end of the drill pipe.

In order to permit inserting of the first drill pipe element (the core pipe) through the two chucks 21, 27, the chucks must be open simultaneously. For this purpose, the operator sets the rotary control valve 57 in the position b, the neutral position, and sets the selector valve 61 and the feed control valve 58 in the position a. As a result, the drill 14 advances until it stops in its advanced stop position. The two chucks 21, 22 are now open. Alternatively, the selector valve 61 and the feed control valve 58 can be set in the position c so that the drill 14 stops in its retracted stop position.

In connection with the drilling apparatus described above, the two chucks 21, 27 are thus controlled automatically. During drilling and during making and breaking of joints, the controlling of the chucks is accomplished by means of he control valve 57 of the rotary motor, and, during introducing of and withdrawing of the drill string, it is effected by means of the control valve 58 of the feed motor.

Especially in connection with large drilling apparatus, it can be desirable to drill with a relatively high rotary speed in rocks, a lower rotary speed and a higher torque is required for earth drilling and for making and breaking joints. For this purpose, a two speed gear box (nonillustrated) may be operationally connected between the rotary motor 32 and the chuck 27 so that two different rates of transmission between the motor and chuck are achieved.

When the drilling apparatus is used for drilling downwards and the joint between two drill string elements connected to each other is to be broken, relieve of pressure (unload) of these elements is accomplished according to the invention by connecting a pressure fluid conduit 100 between the supply conduit 37 of the rotary motor 32 and the supply conduit 19 of the feed motor 17. With the feed control valve 58 in position b, the neutral position, wherein the chuck 21 grips a string element and the chuck 27 grips another string element connected thereto, with the selector valve 61 in position b, wherein there is no pressure in the supply conduits 18 and 19, and with the rotation control valve 57 in position c, wherein the motor 32 rotates in a reverse direction, pressure oil is fed not only to the motor 32 but also from the conduit 37 to the conduit 19 via the conduit 100, so that the feed motor 17 is pressurized and the chuck 27 and the devices connected thereto, such as the motor 32, will be affected by an upward force directed from the chuck 21, this force generally corresponding to the weight of the chuck 27 and the devices connected thereto.

In order to introduce a sufficient flow to the motor (cylinder) 17 there is a flow regulating restricting means 101 in the conduit 100. This flow regulation and a pressure regulation can also or instead be accomplished by means of a pressure regualating valve 103 in the conduit 100. To prevent return flow through the conduit 100 there is a one-way valve 102 therein between the means 101 and the conduit 19.

The valve 70, which also prevents the chuck 27 and the devices connected thereto from being moved only because of their dead weight, also limits the pressure of the threads of the string elements when the joints between these elements are broken.

When the drilling apparatus is used for drilling upwards one end of the conduit 100 is connected to the conduit 36 instead of the conduit 37 and the other end thereof is connected to the conduit 18 instead of to the conduit 19. When making a joint between two string elements and with the valve 57 in position a and the valves 58 and 61 in the last mentioned positions b the chuck 27 and the devices connected thereto will be moved by the motor (cylinder) 17 towards the stationary chuck 21 with a force generally corresponding to the total weight of the movable chuck 27 and the devices connected thereto (said total weight forces the string element gripped by the chuck 27 to be moved in a direction from the stationary chuck 21), so that the threads of the string elements are unloaded and thus are subjected to very little wear. When the apparatus is used for drilling upwards also connections of the valves 70 and 71 are disconnected from the conduit 19 and are connected to the conduit 18 in order to compensate for the weight of the chuck 27 and the devices connected thereto and to prevent said chuck and devices from being moved because of their dead weight.

The invention is not limited to the described embodiments, but may be modified in various ways within the scope of the claims.

I claim:

1. A devidce in rock or earth drilling apparatus for rotary drilling including an axially stationary chuck and an axially movable chuck which is rotated by a reversible pressure fluid driven rotary motor having a pressure fluid supply conduit for each direction and which is moved forwards and backwards by a reversible pressure fluid driven feed motor having a pressure fluid supply conduit for each direction, the chucks being actuated to withdraw from or insert in a drill hole a drill string composed by a number of threaded string elements and are also actuated to make or break the joints between the string elements, characterized in that one of the pressure fluid supply conduits of the feed motor is connected to one of the pressure fluid supply conduits of the rotary motor, so that, when breaking or making the joint between two sting elements gripped by the two chucks, the feed motor will be actuated to move the axially movable chuck relatively to the stationary chuck in a direction to decrease the pressure on the threads accomplished by the weight of the axially movable chuck and devices connected thereto, and in that a one-way valve preventing pressure fluid return to the rotary motor and at least one of a flow-regulating means and a pressure regulating valve are provided in a conduit connecting said pressure fluid supply conduits of said feed motor and said rotary motor.

2. A device in rock earth drilling apparatus for rotary drilling including an axially stationary chuck and an axially movable chuck which is rotated by a reversible pressure fluid driven rotary motor having a pressure fluid supply conduit for each direction and which is moved forwards and backwards by a reversible pressure fluid driven feed motor having a pressure fluid supply conduit for each direction, the chucks being actuated to withdraw from or insert in a drill hole a drill string composed by a number of threaded string elements and are also actuated to make or break the joints between the string elements, characterized in that one of the pressure fluid supply conduits of the feed motor is connected to one of the pressure fluid supply conduits of the rotary motor, so that, when breaking or making joints between two string elements gripped by the two chucks, the feed motor will be actuated to move the axially movable chuck relatively to the stationary chuck in a direction to decrease the pressure on the threads accomplished by the weight of the axially movable chuck and devices connected thereto.

3. A device according to claim 2, characterized by a flow regulating means in a conduit connecting said pressure fluid supply conduits of said feed motor and said rotary motor.

4. A device according to claim 3, characterized by a one-way valve in said conduit, said valve preventing pressure fluid return to the rotary motor.

5. A device according to claim 4 characterized by a pressure-regulating valve in said conduit.

6. A device according to any one of claims 2, 3, 4, or 1, characterized by one of the chucks being designed to release the drill string when loaded by pressure fluid and grip it when relieved of pressure fluid and the other chuck being designed to grip the drill string when loaded by pressure fluid and release it when relieved of pressure fluid, and, at least when the drill string is introduced in or withdrawn from the drill hole, both the chucks and one of the supply conduits of the feed motor generally simultaneously are loaded by pressure fluid or generally simultaneously are relieved of pressure fluid by means of a common control means.

7. A device according to claim 5 wherein said one chuck comprises the stationary chuck.

8. A device in rock or earth drilling apparatus for rotary drilling including an axially stationary chuck and an axially movable chuck which is rotated by a reversible pressure fluid driven rotary motor having a pressure fluid supply conduit for each direction and which is moved forwards and backwards by a reversible pressure fluid driven feed motor having a pressure fluid supply conduit for each direction, the chucks being actuated to withdraw from or insert in a drill hole a drill string composed by a number of threaded string elements and are also actuated to make or break the joints between the string elements, characterized in that one of the pressure fluid supply conduits of the feed motor is connected to one of the pressure fluid supply conduits of the rotary motor, so that, when breaking or making the joint between two string elements gripped by the two chucks, the feed motor will be actuated to move the axially movable chuck relatively to the stationary chuck in a direction to decrease the pressure on the threads accomplished by the weight of the axially movable chuck and devices connected thereto, in that a flow regulating means is provided in a conduit connecting said pressure fluid supply conduits of said feed motor and said rotary motor, and in that a one-way valve is provided in said conduit, said valve preventing pressure fluid return to the rotary motor, and also a pressure-regulating valve in said conduit.

9. A device according to claim 8 characterized by one of the chucks being designed to release the drill string when loaded by pressure fluid and grip it when relieved of pressure fluid, and, at least when the drill string is introduced in or withdrawn from the drill hole, both the chucks and one of the supply conduits of the feed motor generally simultaneously are loaded by pressure fluid or generally simultaneously are relieved of pressure fluid by means of a common control means.

* * * * *

UNITED STATES PATENT AND TRADEMARK OFFICE

CERTIFICATE OF CORRECTION

PATENT NO. : 4,458,764

DATED : July 10, 1984

INVENTOR(S) : Eskil Lidstrand

It is certified that error appears in the above-identified patent and that said Letters Patent is hereby corrected as shown below:

Column 2, line 53, delete "is", second occurrence, and insert --it-- therefor;

Column 2, line 61, before "Fig.", insert --in--;

Column 4, line 52, delete "the", second occurrence, and insert --this-- therefor;

Column 5, line 12, delete "he" and insert --the-- therefor;

Column 5, line 51, delete "regualating" and insert --regulating-- therefor;

Column 6, line 18, delete "devidce" and insert --device-- therefor;

Column 6, line 33, delete "sting" and insert --string-- therefor;

Column 6, line 44, after "rock" and before "earth", insert --or--; and

UNITED STATES PATENT AND TRADEMARK OFFICE

CERTIFICATE OF CORRECTION

PATENT NO. : 4,458,764

DATED : July 10, 1984

INVENTOR(S) : Eskil Lidstrand

It is certified that error appears in the above-identified patent and that said Letters Patent is hereby corrected as shown below:

Column 7, line 18, delete "5" and insert --6-- therefor.

Signed and Sealed this

Ninth Day of April 1985

[SEAL]

*Attest:*

DONALD J. QUIGG

*Attesting Officer* *Acting Commissioner of Patents and Trademarks*